US007385126B1

(12) United States Patent
Moghaddam

(10) Patent No.: US 7,385,126 B1
(45) Date of Patent: Jun. 10, 2008

(54) DRUM SUPPORT PADS

(75) Inventor: Akbar Moghaddam, San Francisco, CA (US)

(73) Assignee: Drum Workshop, Inc., Oxnard, CA (US)

( * ) Notice: Subject to any disclaimer, the term of this patent is extended or adjusted under 35 U.S.C. 154(b) by 50 days.

(21) Appl. No.: 11/493,170

(22) Filed: Jul. 27, 2006

(51) Int. Cl.
*G10D 13/02* (2006.01)

(52) U.S. Cl. ..... 84/421

(58) Field of Classification Search ..... 84/411 R, 84/421
See application file for complete search history.

(56) References Cited

U.S. PATENT DOCUMENTS 7,205,468 B1 * 4/2007 Johnson ..... 84/327
2006/0225559 A1 * 10/2006 Frank et al. ..... 84/421

* cited by examiner

*Primary Examiner*—Kimberly Lockett
(74) *Attorney, Agent, or Firm*—William W. Haefliger

(57) ABSTRACT

In combination at least one drum having a drum head and a shell supporting the head, and having an outer side, at least one pad located proximate the shell outer side, to be supported by a drummer's leg, or legs, whereby the drum can be supported by the drummer's leg or legs via the pad.

16 Claims, 4 Drawing Sheets

DRUM SUPPORT PADS

BACKGROUND OF THE INVENTION

This invention relates generally to drum supports, and more particularly to supporting of a drum or drums between the knees of a drummer.

There is need for improvements in the supporting of a drum or drums, as for example bongo drums, between the user's knees, to prevent or block slip-down of the drum or drums, as during use. Bongo drums typically are interconnected in pairs, so that the space occupied by the two drums between the knees is considerable, the drummer's legs having to diverge to provide such space; consequently, the force of knee gripping of the drums, to prevent slip down, is reduced by such leg divergence.

SUMMARY OF THE INVENTION

It is a major object of the invention to provide for improved drum support, as by or between a drummer's knees. Basically, the invention is embodied in a) at least one drum having a drum head and a shell supporting the head, and having an outer side, b) at least one pad located proximate the shell outer side, to be supported by a drummer's leg, or legs, whereby the drum can be supported by the drummer's leg or legs via the pad or pads.

As will appear, a strap is typically provided for holding the pad attached to a drum shell outer side; and a stiffener such as a rib is typically carried by the pad to extend proximate the shell outer side to assist in pad support to the drum outer side. The rib is preferably provided in the form of a plate.

It is another object of the invention to provide protrusions carried by the drum and protruding at the shell outer side, the rib extending in drum weight transmitting relation to the protrusions, whereby downward slippage of the drum relative to the user's leg is blocked.

Yet another object is to provide a second drum having a drum head and a shell supporting the second drum head, the second drum connected to the one drum, and a second pad located proximate the second drum shell outer side to be supported by a second leg of the drummer, whereby both drums can be supported by the drummer's legs, via such pads, and stiffeners. As referred to above, the first and second drums advantageously comprise bongo drums.

An additional object is to provide straps for holding the pads attached to the outer sides of the respective one drum and second rum; the ribs preferably provided to be carried by the two pads, to extend proximate the outer sides of the drums to assist in attachment of the pads and stiffeners to the outer sides of the drums.

A further object is to provide protrusions carried by the two drums, which are interconnected, and protruding from the drum outer sides, the ribs extending in drum weight transmitting relation to the protrusions, whereby downward slippage of the two drums relative to the user's legs is blocked. The protrusions advantageously comprises metallic appendages to the two drums.

Yet another object is to provide pockets in the pads in which the ribs are easily received, and may be withdrawn, for transport.

These and other objects and advantages of the invention, as well as the details of an illustrative embodiment, will be more fully understood from the following specification and drawings, in which:

DRAWING DESCRIPTION

DETAILED DESCRIPTION

Figure 1:
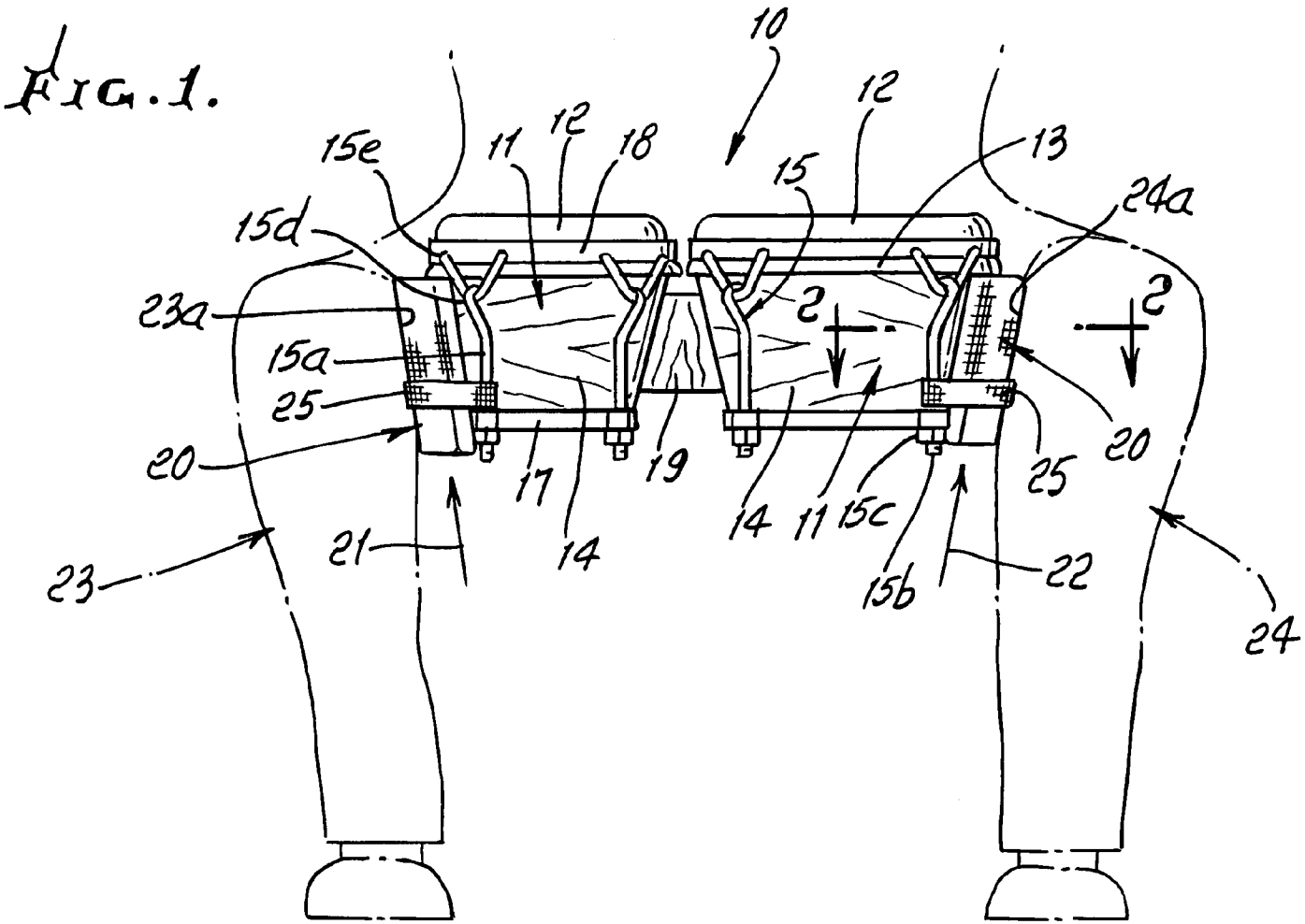
FIG. 1 is a front application showing positioning of drums between a user's knees.

In the drawings a pair 10 of bongo drums 11 is shown. The drums have heads 12 attached at 13 to drum walls or shells 14. The shells are frusto-conical, and diverge in an upward direction. Protrusions 15 are carried by the drums to protrude at their outer sides. The protrusions are shown as rod-like metallic holders attached to the two drums. See for example holder rods 15*a* connected as via threads 15*b* and nuts 15*c* at their lower ends to a holder base 17, and connected at their upper ends 15*d* to holder brackets or yokes 15*e* attached to head holder band 18. Base 17 and band 18 extend about each drum. Structure 19 intermediate the two drum shells rigidly interconnects the drums.

In accordance with the invention, at least one pad is located proximate the outer side of at least one drum shell 14, to be supported by a drummer's leg or legs, whereby the drum can be supported by his leg or legs, via the pad or pads. Preferably, two such pads 20 are provided, to extend in upwardly divergent directions 21 and 22, adjacent the inner sides of the knees 23*a* and 24*a* of legs 23 and 24, for support.

Figure 2:
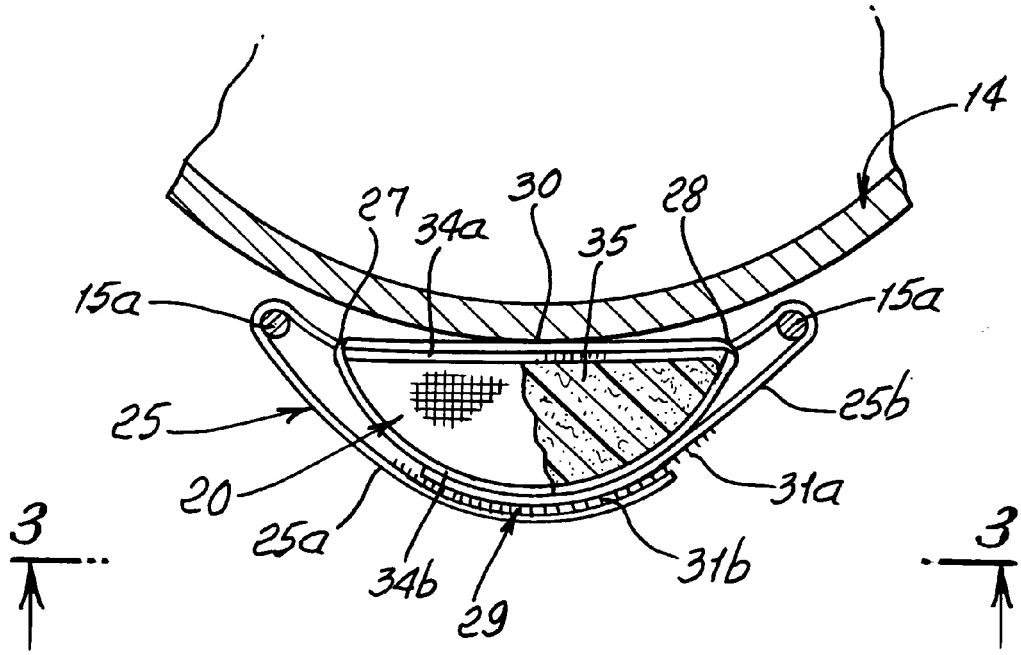
FIG. 2 is an enlarged section taken in plane view on lines 2-2 of FIG. 1.
Figure 4:
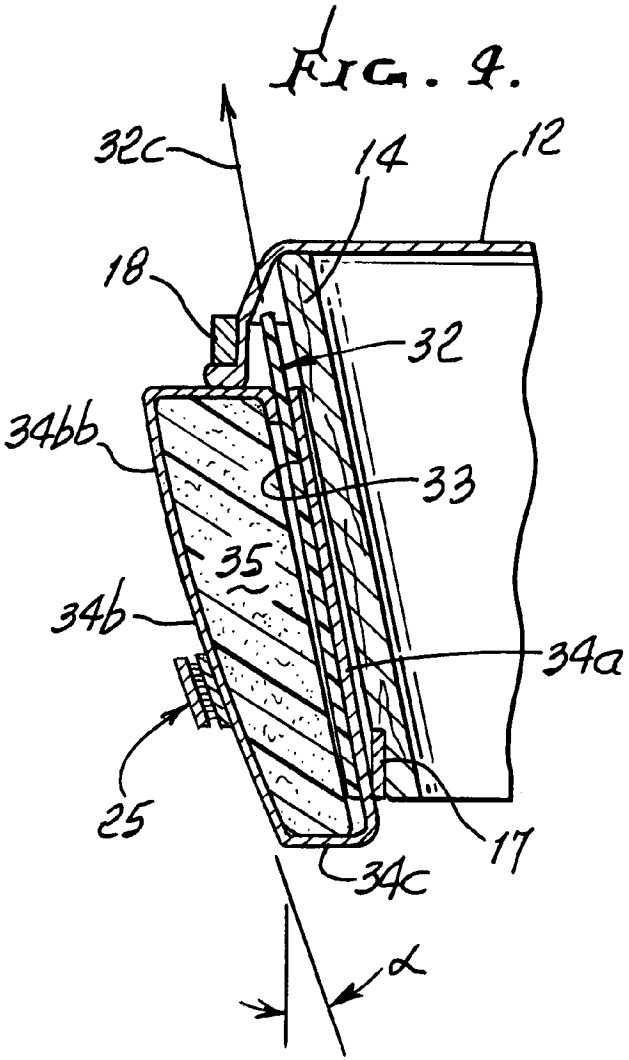
FIG. 4 is a section taken in elevation on lines 4-4 of FIG. 3.

At least one strap 25 holds a pad in position engaging the shell at side location 30 (see FIG. 2) and preferably two such straps 25 respectively hold the two pads in position, attached to the drums. Each strap 25 is shown in FIGS. 1, 2 and 4 as looping about two of the upwardly extending, circularly spaced rods 15*a*, each strap attached to the inner side of the pad, as at locations 27 and 28. Strap sections 25*a* and 25*b* are releasably interconnected at 29, as by overlapping hook and pile (VELCRO) elements, indicated at 31*a* and 31*b* whereby the strap sections can be tightened or loosened, allowing pad removal.

Figure 5:
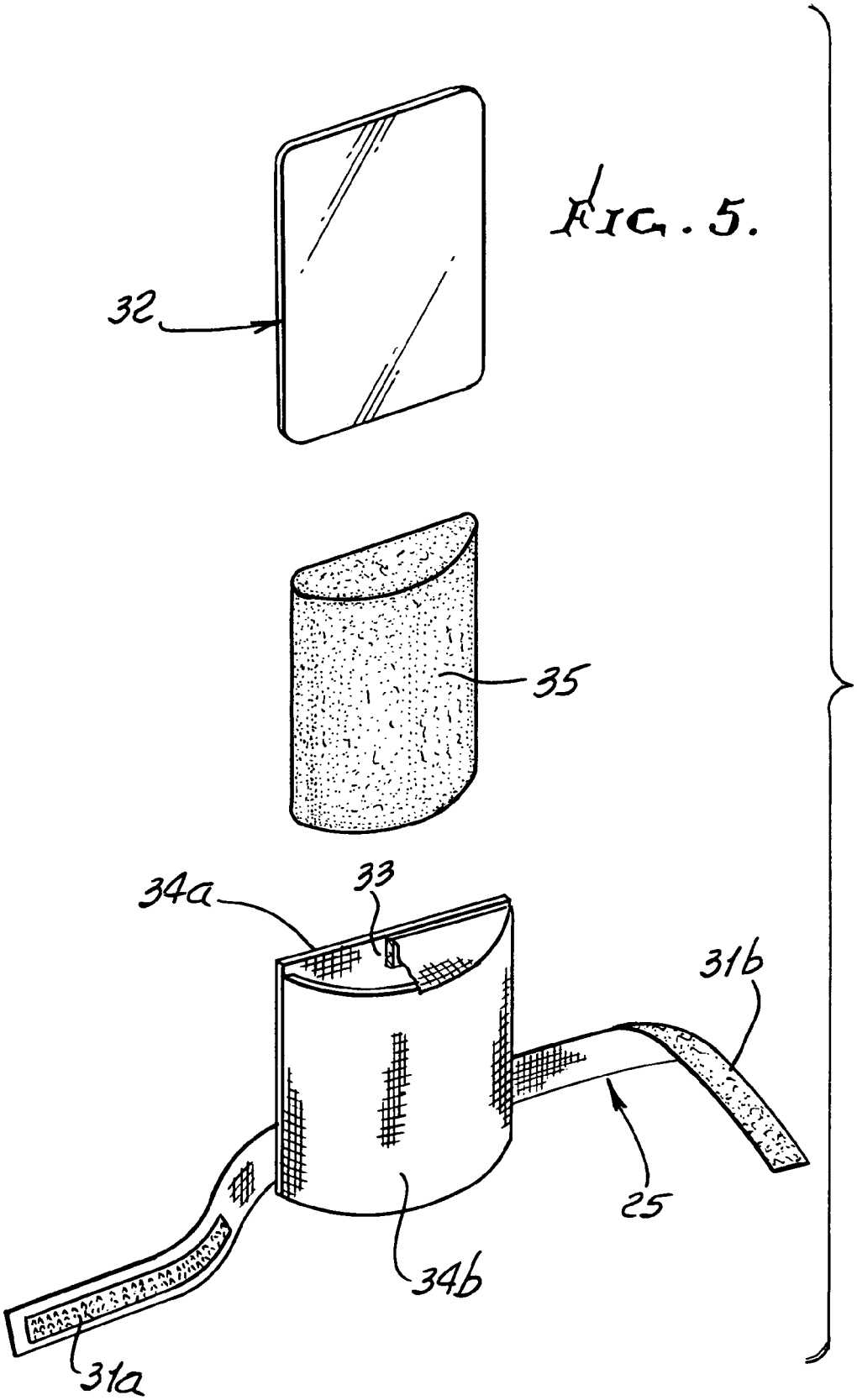
FIG. 5 is an exploded view of the pad and plate structure incorporated in the drum support.

Also shown are rigid or semi-rigid stiffeners in the form of ribs 32 carried by the pads to extend proximate the shell outer sides, to stiffen the pads and assist in pad positioning at the drum outer side. FIG. 5 shows a rib 32 in the form of a plastic or metal plate that extends downwardly in a pocket 33 formed by the pad fabric that includes generally flat fabric section 34*a*, and outwardly bulging fabric section 34*b*, and a pocket bottom 34*c*. A compressible pocket insert 35, such as a foam or rubber insert, is provided, between 34*a* and 34*b* to position the rib in the pad and to cushion the drum loading exerted against the drummer's knees. The use of a stiffener rib keeps the pad in position and holds it against slippage, whereby the bongo drums are held against downward slippage between the drummer's knees.

Figure 3:
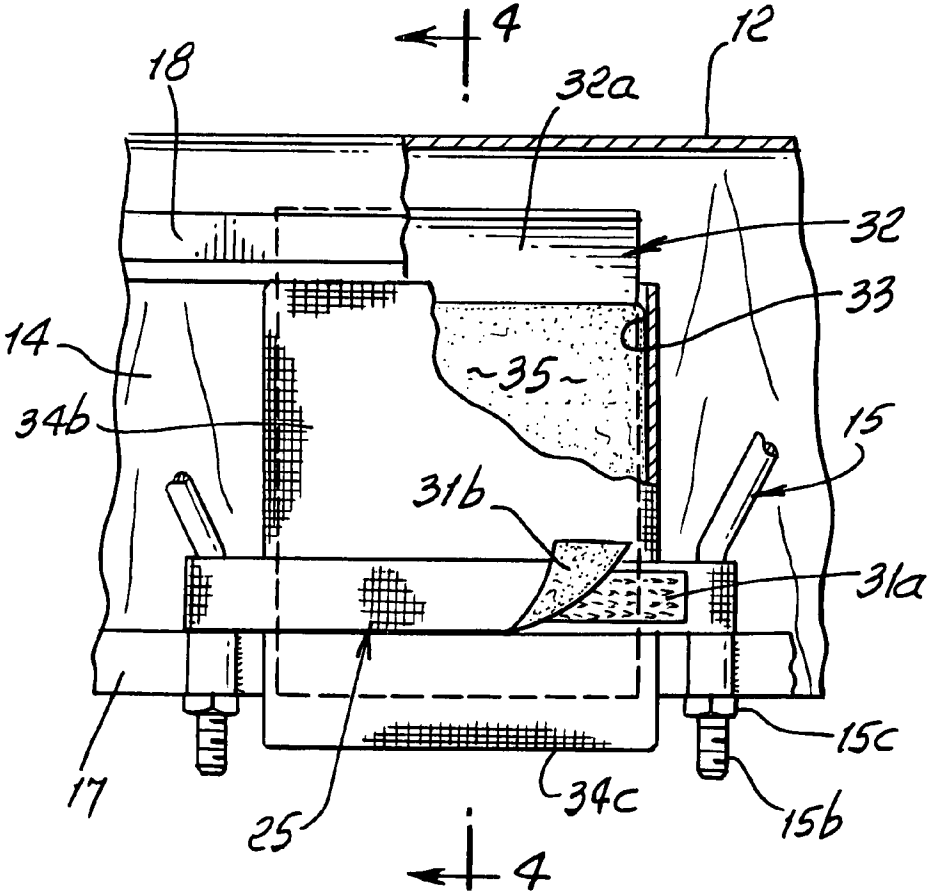
FIG. 3 is an enlarged elevation taken on lines 3-3 of FIG. 2.

FIGS. 3 and 4 show the stiffener plate or rib 32 protruding upwardly at 32*a* at the top of the pocket, for adjustment or retrieval. Note that the rib extends in an upwardly diverging or angled direction 32*c*, near the drum shell or wall. Strap 25 holds the lower extent of the pad in a position to retain the rib 32 in its angled position, whereby an assembly is provided that prevents drum slippage downwardly. In this regard, the drummer's knee engages the outer side 34*bb* of the pad fabric section 34*b* that bulges outwardly, and extends upwardly at angle α relative to vertical, as shown. In effect, the pad and rib act as an angled and stiffened shelf, blocking downward slippage of the drum, relative to the user's knees, while at the same time, each pad provides cushioned support against the knee, for comfort.

The removability of the strap allows ready disassembly of the pads and ribs, for transport.

The method of drum support includes the steps;

a) providing support pads, b) locating the pads between the respective drums and the inner sides of the knees of a drummer, c) providing stiffeners, d) and inserting the stiffeners between medial zones of the pads and the sides of the two drums, in lateral alignment with the drummer's knees.

I claim:

1. In combination:

a) at least one drum having a drum head and a shell supporting the head, and having an outer side, b) at least one pad located proximate the shell outer side, to be supported by a drummer's leg, or legs, whereby the drum can be supported by the drummer's leg or legs via the pad, c) and including a rib carried by the pad to extend proximate the shell outer side to assist in pad attachment to the drum outer side, d) and including protrusions carried by the drum and protruding at said shell outer side, the rib extending in drum weight transmitting relation to the protrusions, whereby downward slippage of the drum relative to the user's leg is blocked.

2. The combination of claim 1 including a strap holding the pad attached to the drum shell outer side.

3. The combination of claim 1 wherein the rib is a plate.

4. In combination:

a) at least one drum having a drum head and a shell supporting the head, and having an outer side, b) at least one pad located proximate the shell outer side, to be supported by a drummer's leg, or legs, whereby the drum can be supported by the drummer's leg or legs via the pad, c) and a second drum having a drum head and a shell supporting the second drum head, the second drum connected to the one drum, and a second pad located proximate the second drum shell outer side to be supported by a second leg of the drummer, whereby both drums can be supported by the drummer's legs, via said pads.

5. The combination of claim 4 wherein said one drum and said second drum are bongo drums.

6. The combination of claim 4 including straps holding the pads attached to the outer sides of the respective one drum and second drum.

7. The combination of claim 4 including ribs carried by the pads to extend proximate the outer side of the one and second drums to assist in attachment of the pads to the outer sides of the drums.

8. The combination of claim 7 including protrusions carried by the drums and protruding from the said drum outer sides, the ribs extending in drum weight transmitting relation to the protrusions, whereby downward slippage of the two drums relative to the user's legs is blocked, said two drums being interconnected.

9. The combination of claim 8 wherein the ribs are plates.

10. The combination of claim 9 including pockets in the pads in which the ribs are received.

11. The combination of claim 8 wherein the protrusions are rod-like metallic holders attached to the drums.

12. The combination of claim 9 wherein the ribs have faces that face toward the drum shells.

13. The combination of claim 10 wherein the ribs are retained adjacent the drum shells, and to extend upwardly at upwardly divergent angles, the pads having outer sides engageable with drummer's knees.

14. The combination of claim 13 including compressible inserts in the pockets at the outer sides of the ribs.

15. In the method of supporting a pair of interconnected bongo type drums having sides, for playing, and with respect to the drummer's knees having inner sides the steps that include:

a) providing support pads, b) locating the pads between the respective drums and said inner sides of the knees of the drummer, c) providing stiffeners, d) and inserting the stiffeners between medial zones of the pads and the sides of the two drums, in lateral alignment with the drummer's knees.

16. The method of claim 15 wherein the stiffeners are provided in the form of plates, and locating the plates to extend upright, and divergently.

* * * * *